US011390965B2

(12) United States Patent
Yin et al.

(10) Patent No.: US 11,390,965 B2
(45) Date of Patent: Jul. 19, 2022

(54) METHOD OF MANUFACTURING HIGH-STRENGTH SYNTHETIC FIBER UTILIZING HIGH-TEMPERATURE MULTI-SECTIONAL DRAWING

(71) Applicant: Shi Yin, Zhejiang (CN)

(72) Inventors: Shi Yin, Zhejiang (CN); Feng Shi, Zhejiang (CN)

(73) Assignee: Shi Yin, Zhejiang (CN)

( * ) Notice: Subject to any disclaimer, the term of this patent is extended or adjusted under 35 U.S.C. 154(b) by 301 days.

(21) Appl. No.: 16/462,578

(22) PCT Filed: Nov. 20, 2017

(86) PCT No.: PCT/CN2017/111905
§ 371 (c)(1),
(2) Date: May 21, 2019

(87) PCT Pub. No.: WO2018/095296
PCT Pub. Date: May 31, 2018

(65) Prior Publication Data

US 2020/0063290 A1 Feb. 27, 2020

(30) Foreign Application Priority Data

Nov. 22, 2016 (CN) ..... 201611044500.0
Nov. 22, 2016 (CN) ..... 201611046025.0
Nov. 22, 2016 (CN) ..... 201611046065.5

(51) Int. Cl.
*D01D 5/088* (2006.01)
*D01D 5/16* (2006.01)
(Continued)

(52) U.S. Cl.
CPC ..... *D01D 5/08* (2013.01); *D01D 5/0985* (2013.01); *D01D 5/12* (2013.01); *D01F 1/10* (2013.01);
(Continued)

(58) Field of Classification Search
CPC ..... D01D 5/06; D01D 5/08; D01D 5/088; D01D 5/0985; D01D 5/12; D01D 5/16;
(Continued)

(56) References Cited

U.S. PATENT DOCUMENTS 5,353,583 A * 10/1994 Tanae ..... D02J 13/00 57/288
2010/0300132 A1* 12/2010 Schultz ..... D04H 1/48 62/259.1
(Continued)

FOREIGN PATENT DOCUMENTS

CN 100999833 A 7/2007
CN 101187070 A 5/2008
(Continued)

OTHER PUBLICATIONS

Translation of CN 100999833 A (published on Jul. 18, 2007).*

*Primary Examiner* — Leo B Tentoni
(74) *Attorney, Agent, or Firm* — Mayer & Williams, PC; Stuart H. Mayer

(57) ABSTRACT

A method of manufacturing a high-strength synthetic fiber utilizing high-temperature multi-sectional drawing, two-stage high-temperature multi-sectional drawing, or multi-stage high-temperature multi-sectional drawing. The method comprises the following steps: performing, on a synthetic resin, melt spinning or melt extrusion, cooling, multi-sectional high-temperature drawing, heat setting and a fiber surface treatment, wherein the multi-sectional high-temperature drawing comprises independently adjusting temperatures at a front section and a rear section of an furnace, and the temperature at the rear section is higher than that at the front section. The temperature adjustment is performed on different locations in the furnace and according to a crystallization orientation of a fiber molecular chain, significantly increasing fiber strength. The method is widely
(Continued)

applicable to manufacturing of various types of fibers, enhancing application performance of the fibers.

14 Claims, 2 Drawing Sheets

(51) Int. Cl.

| | |
|---|---|
| ***D01D 10/02*** | (2006.01) |
| ***D01F 6/04*** | (2006.01) |
| ***D01F 6/06*** | (2006.01) |
| ***D01F 6/12*** | (2006.01) |
| ***D01F 6/14*** | (2006.01) |
| ***D01F 6/18*** | (2006.01) |
| ***D01F 6/60*** | (2006.01) |
| ***D01F 6/62*** | (2006.01) |
| ***D01F 6/74*** | (2006.01) |
| ***D02J 1/22*** | (2006.01) |
| ***D02J 3/00*** | (2006.01) |
| ***D02J 3/10*** | (2006.01) |
| ***D02J 13/00*** | (2006.01) |
| ***D01D 5/08*** | (2006.01) |
| ***D01D 5/12*** | (2006.01) |
| ***D01F 1/10*** | (2006.01) |
| ***D01D 5/098*** | (2006.01) |

(52) U.S. Cl.
CPC ..... *D02J 1/228* (2013.01); *D02J 13/001* (2013.01); *D01F 6/605* (2013.01); *D10B 2321/021* (2013.01); *D10B 2321/022* (2013.01); *D10B 2321/042* (2013.01); *D10B 2321/06* (2013.01); *D10B 2321/10* (2013.01); *D10B 2331/02* (2013.01); *D10B 2331/021* (2013.01); *D10B 2331/04* (2013.01); *D10B 2331/14* (2013.01)

(58) Field of Classification Search
CPC .. D01D 10/02; D01F 1/10; D01F 6/04; D01F 6/06; D01F 6/12; D01F 6/14; D01F 6/18; D01F 6/60; D01F 6/605; D01F 6/62; D01F 6/74; D02J 1/22; D02J 1/228; D02J 3/00; D02J 3/10; D02J 13/00; D02J 13/001; D10B 2321/021; D10B 2321/022; D10B 2321/042; D10B 2321/06; D10B 2321/10; D10B 2331/02; D10B 2331/021; D10B 2331/04; D10B 2331/14
USPC ..... 264/40.6, 178 R, 184, 185, 203, 210.2, 264/210.5, 210.6, 210.7, 210.8, 211.14, 264/211.15, 211.17, 331.12, 331.14, 264/331.17, 331.18, 331.19
See application file for complete search history.

(56) References Cited

U.S. PATENT DOCUMENTS

2012/0228797 A1* 9/2012 Wu ..... D01F 6/74 264/184
2013/0273799 A1* 10/2013 Luo ..... D01D 5/0985 442/181

FOREIGN PATENT DOCUMENTS

| | | | |
|---|---|---|---|
| CN | 101265609 | A | 9/2008 |
| CN | 101775667 | A | 7/2010 |
| CN | 106591973 | A | 4/2017 |
| CN | 106637447 | A | 5/2017 |
| CN | 106702508 | A | 5/2017 |

* cited by examiner

METHOD OF MANUFACTURING HIGH-STRENGTH SYNTHETIC FIBER UTILIZING HIGH-TEMPERATURE MULTI-SECTIONAL DRAWING

TECHNICAL FIELD

The present invention relates to a preparation method of synthetic fibers, and belongs to the field of preparation of polymer materials.

TECHNICAL BACKGROUND

Synthetic fibers have the advantages of high strength, low cost, good chemical stability, acid and alkali resistance, microbial resistance and wear resistance and so on. They are widely used in many fields such as building materials, safety protection, aerospace, medical, sports, electronics, military. The basic preparation processes include melt spinning or melt extrusion of synthetic resin, bath cooling, high temperature drawing, heat setting, fiber surface treatment and winding package.

CN1401021A discloses a method of producing a high strength polyester amide fibers. The production process comprises the following steps: spinning a polyester amide copolymer melt, bath cooling at a temperature below 20° C. to obtain undrawn filaments in an amorphous state and then drawing at a high temperature of 70 to 110° C. in one or more ovens with a total drawing ratio of more than 4.5 to obtain high strength fibers.

CN 1448546A discloses a preparation method of ultra to high strength and ultra to high modulus polyethylene fibers. The method comprises the following steps: melting and extruding polyethylene, spinning in a spinning box, and then drawing at a high temperature in one or more ovens, wherein the total drawing ratio is more than 70.

CN 1515711A discloses a preparation method of high strength polypropylene fiber. The method comprises the following steps: melting and extruding polypropylene on a melting spinning machine, winding, and then carrying out two drawing and one thermal relaxation in two ovens respectively. The first pre-drawing is in normal temperature, and the second drawing is in temperature of 90 to 140° C.

CN 101899722A discloses a process for the preparation of high strength and high modulus polyvinyl alcohol coarse denier fibers. In the method, the polyvinyl alcohol is melt to extruded through a single to screw extruder, and then subjected to multi-stage drawing in ovens in 120 to 150° C. to achieve drawing ratio of 10 to 16. The last step is to perform high temperature heat setting.

In the whole fiber preparation processes, high temperature drawing is the key step to improve fiber strength. The length of the hot oven for drawing at high temperature is usually 4 to 7 meters. During this distance, fibers will undergo a large number of oriented crystallization, thus exhibiting excellent mechanical properties. However, in the current technology and the disclosed patents, the enhancement effects are limited and do not achieve very satisfied results.

SUMMARY OF THE INVENTION

In order to solve the above problems, the present invention provides a method for preparing a high strength synthetic fiber.

The invention relates to a method for preparing high strength synthetic fibers by high temperature segmented drawing processes, which comprises the following steps:

melt spinning or melt extrusion of synthetic resins, cooling, high temperature segmented drawing in an oven and heat setting. In the high temperature segmented drawing, wherein the temperature of the front part and the latter part of the oven is independently controlled, where the temperature of the latter part is higher than that of the front part.

The preferred heating temperature of the front part in the oven is 30 to 200° C., and that of the latter part is 50 to 300° C.

The preferred drawing ratio is 1 to 50.

The high temperature segmented drawing can comprise two stages. That means, the high temperature segmented drawing comprise a first and a second drawing stages in two ovens respectively, and the heating temperature of the front part of the second drawing stage is not lower than that of the latter part of the first drawing stage.

Preferably, in the first drawing stage, the temperature of the front part in the first oven is 30 to 200° C. and the heating temperature of the latter part is 50 to 300° C.; in the second drawing stage, the heating temperature of the front part in the second oven is 100 to 300° C., and the heating temperature of the latter part is 120 to 300° C.

Preferably, the drawing ratio is 1 to 50 in the first drawing stage, and the drawing ratio is 1 to 80 in the second drawing stage.

The high temperature segmented drawing process can comprise multiple stages. That means, the high temperature segmented drawing process comprises sequentially entering multiple ovens, and the heating temperature and drawing ratio of the front part of latter oven is not lower than that of the front one.

Preferably, at least three stages of high temperature drawing are included, and the first three stages of high temperature drawing are as follows:

The heating temperature of the front part in the first drawing stage is 30 to 200° C., and the heating temperature in the latter part is 50 to 200° C. The heating temperature of front part in the second drawing stage is 100 to 250° C., and the heating temperature of the latter stage is 120 to 250° C. The heating temperature of front part in the third drawing stage is 100 to 300° C., and the heating temperature of the latter part is 120 to 300° C.

It is further preferred that the multi-stage high temperature segmented drawing process comprises three stages.

The preferred first drawing ratio is 1 to 50, the second drawing ratio is 1 to 80, and the third drawing ratio is 1 to 100.

In addition, if there are more than three stages in multi-stage high temperature segmented drawing, the temperature and the drawing ratio after the third stage are the same as those of the third stage.

Preferably, the length ratio of the front heating part to the latter heating part in the oven is 1:5 to 5:1.

It is further preferred that the length ratio of the front heating part in the oven to the latter heating part is 1:3 to 3:1.

The synthetic resins are preferably one of or a mixture of more than one of the following chemicals: polypropylene, polyethylene, polyacrylonitrile fiber, polyester, polyamide, polyvinyl alcohol, polyvinyl formal, polyethylene terephthalate, polybenzimidazole, polytetrafluoroethylene, Poly(p-phenylene terephthalamide) and polyimide.

The synthetic resins may also include modifiers, modified resins or modified fillers.

The preferred modifiers, modified resins or modified fillers are one of or a mixture of following chemicals: silane coupling agent Si-69, silane coupling agent KH570, silane coupling agent KH550, silane coupling agent KH151, silica gel anti-blocking agent, titanate coupling agent, aluminate coupling agent, tetraethyl orthosilicate (TEOS), color masterbatch, plasticizing masterbatch, high-temperature-resistant masterbatch, anti-corrosion masterbatch, defoaming masterbatch, inorganic ultrafine particles, maleic anhydride grafted polypropylene, maleic anhydride grafted polyethylene, polyethylene glycol, polybutylene adipate, and polycaprolactone.

The fiber surface treatment is preferably performed after heat setting and the fiber surface treatment is preferably indentation and/or surface modification.

The technical effects of the present invention are as follows:

The present invention provides a method for preparing high strength synthetic fibers by high temperature segmented drawing. One, two or more ovens are adopted to carry out one, two or more stages of high temperature segmented drawing in each oven. In the high temperature drawing process, temperature of the front part and the latter part in the oven can independently controlled and the control range of temperature is 30 to 300° C. The control of temperature depends on the type of synthetic resins, drawing speed and the number of the stages of drawing in high temperature. The drawing ratio is achieved by the speed difference of rollers on both sides of each oven, and the drawing time is determined by the length of the oven and drawing speed.

When fibers just enter the oven and are located in the front part of the oven, their own temperature is low, requiring a heating process. At this time, the crystallinity of the fiber is low, and the heat absorbed is also low. Therefore, a relatively low temperature is set to achieve a better preheating without over activating the molecular chain of the fiber, which can ensure the orientation degree of subsequent molecular chains. When fibers are drawn to the latter part of the oven, the molecular chain will start a large number of oriented crystallization, which requires higher energy. Therefore, a higher temperature is set and will not cause insufficient crystallization due to insufficient heat absorption. According to the present invention, corresponding temperature adjustment is carried out at different positions of the oven according to the orientation crystallization condition of fiber molecular chains. As a result, the strength of fiber is greatly improved.

Furthermore, when two stages or multi stages high temperature segmented drawing is adopted, the strength of the drafted fiber can be further improved by 10 to 30 times on a one stage basis due to highly oriented crystallization of the fiber after drawing due to more drawing processes.

The invention can be widely applied to the preparation of various fibers and greatly improves the service performance of the fibers.

DETAILED DESCRIPTION

The present invention will be further explained below with reference to the figures attached by way of examples.

Embodiment 1

Figure 1:
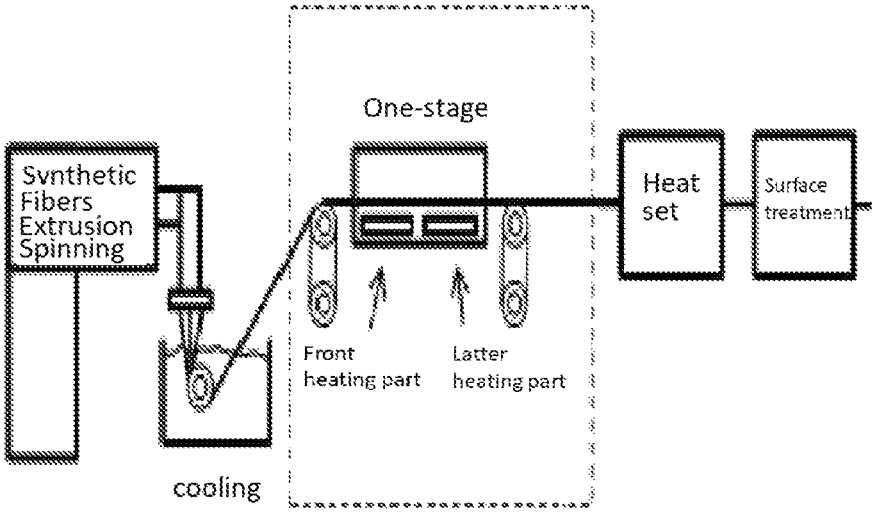
FIG. 1 is a schematic diagram of the device of Embodiment 1 to 3 of the present invention.

This embodiment is applied to the preparation of high strength polypropylene fibers. The preparation process is shown in FIG. 1 and includes the following steps:

Polypropylene resin, maleic anhydride grafted polypropylene, color master batch, high temperature resistant master batch, anti-corrosion master batch and defoaming master batch are fully and evenly mixed and then added into a single screw extruder for melt extrusion. After the fibers are extruded, they are immediately cooled in cooling water to obtain undrawn filaments in an amorphous state. The fibers are subjected to high temperature segmented drawing. The total length of the heating oven is 6 m. The length of the front heating part is 2 m and the temperature is 140° C. while the length of the latter heating part is 4 m and the temperature is 150° C. Two ends of the oven are respectively provided with a roller, the rotating speed of the first roller is 5 m/min, the rotating speed of the second roller is 50 m/min, and the drawing ratio is 10. The drafted fibers are heat set at a high temperature of 120° C. and the rotating speed of the roller of the heat set oven is the same as that of the roller at the rear end of the oven, which is also 50 m/min. The setting time is 40 s. After that, fibers are indented, modified, packaged and cut to obtain the finished product. The tensile strength of the polypropylene fibers in this example reaches 450 MPa and the tensile modulus reaches 7 GPa, which was 25% higher than that of the polypropylene fibers prepared by the conventional method.

Embodiment 2

This embodiment is applied to the preparation of high strength polyester amide fibers. The preparation process is shown in FIG. 1 and includes the following steps:

Nylon 6 and polybutylene adipate are copolymerized and then added into a single screw extruder for melt extrusion. After the fibers are extruded, they are immediately cooled in cooling water to obtain undrawn filaments in an amorphous state. The fibers are subjected to high temperature segmented drawing. The total length of the heating oven is 6 m. The length of the front heating part is 3 m and the temperature is 70° C. The length of the latter heating part is 3 m, the temperature is 80° C. The drawing ratio is 10. The control method of the drawing speed rate is the same as in Embodiment 1. The drafted fibers are heat set, packaged and cut to obtain the finished product. The tensile strength of the polyester amide fiber of this example reaches 800 MPa and the tensile modulus reaches 6 GPa, which is 30% higher than that of the polyester amide fiber prepared by the conventional method.

Embodiment 3

This embodiment is applied to the preparation of high strength polyvinyl alcohol fibers. The preparation process is shown in FIG. 1 and includes the following steps:

After swelling, polyvinyl alcohols are added into a single screw extruder for melt extrusion. After the fibers are extruded, freezing, alcoholysis and neutralization are carried out. The fibers are subjected to high temperature segmented drawing. The total length of the heating oven is 6 m. The length of the front heating part is 4 m and the temperature is 140° C. The length of the latter heating part is 2 m and the temperature is 150° C. The drawing ratio is 8. The control method of the drawing speed rate is the same as in Embodiment 1. The drawn fibers are heat set, packaged and cut at 220° C. to obtain the finished product. The tensile strength of the polyvinyl alcohol fiber in this embodiment reaches 700 MPa and the tensile modulus reaches 25 GPa, which is 15% higher than that of the polyvinyl alcohol fiber prepared by the conventional method.

Embodiment 4

Figure 2:
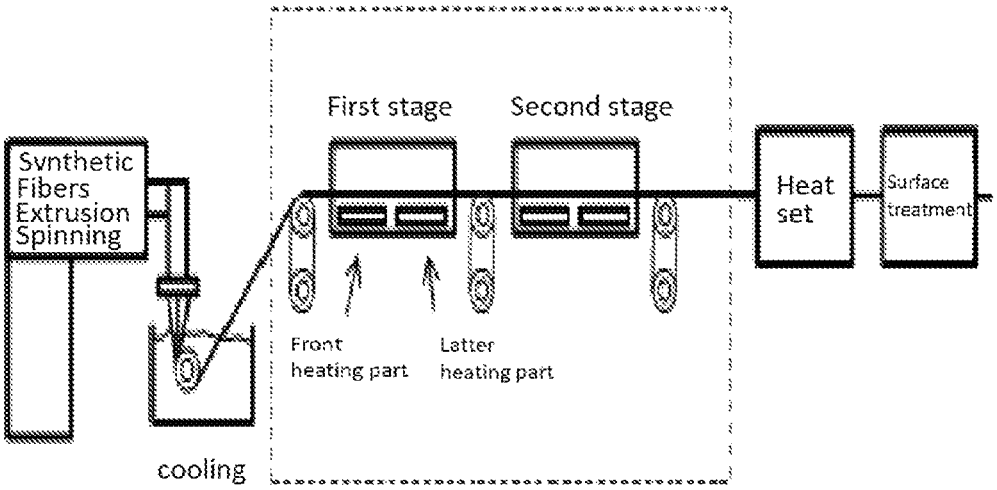
FIG. 2 is a schematic diagram of the device of Embodiment 4 to 6 of the present invention.

This embodiment is applied to the preparation of high strength polypropylene fibers. The preparation process is shown in FIG. 2 and includes the following steps:

Polypropylene resin, maleic anhydride grafted polypropylene, color master batch, high temperature resistant master batch, anti-corrosion master batch and defoaming master batch are fully and evenly mixed and then added into a single screw extruder for melt extrusion. After the fibers are extruded, they are immediately cooled in cooling water to obtain undrawn filaments in an amorphous state. The fiber is subjected to two-stage high temperature segmented drawing. In the first stage, the total length of the heating oven is 6 m. The length of the front heating part is 2 m and the temperature is 50° C. The length of the latter heating part is 4 m and the temperature is 60° C. Both ends of the first oven are respectively provided with a roller. The rotating speed of the first roller is 3 m/min, and the rotating speed of the second roller is 15 m/min. The drawing ratio is 5. In the second stage, the total length of the heating oven is 6 m. The length of the front heating part is 2 m and the temperature is 150° C. The length of the latter heating part is 4 m, and the temperature is 160° C. The roller at the rear end of the first oven and the roller at the front end of the second oven is the same one. The rotating speed of the roller at the rear end of the second oven is 150 m/min, and the drawing ratio is 10. The drafted fibers are subjected to high temperature heat setting. The rotating speed of the roller of the heat setting oven is the same with that of the roller at the rear end of the second oven, the heat setting temperature is 120° C., and the setting time is 40 s. After that, the fibers are indented, modified, packaged and cut to obtain the finished product. The tensile strength of the polypropylene fiber in this embodiment reaches 550 MPa and the tensile modulus reaches 9 GPa.

Embodiment 5

This embodiment is applied to the preparation of high strength polyester amide fibers. The preparation process is shown in FIG. 2 and includes the following steps:

Nylon 6 and polybutylene adipate are copolymerized and then added into a single screw extruder for melt extrusion. After the fibers are extruded, they are immediately cooled in cooling water to obtain undrawn filaments in an amorphous state. The fibers are subjected to two-stage high temperature segmented drawing. In the first stage, the total length of the heating oven is 6 m. The length of the front heating part is 3 m and the temperature is 20° C. The length of the latter heating part is 3 m and the temperature is 30° C. The drawing ratio is 2. In the second stage, the total length of the heating oven is 6 m. The length of the front heating part is 3 m and the temperature is 70° C. The length of the latter heating part is 3 m and the temperature is 80° C. The drawing ratio is 5. The control method of the drawing speed rate is the same as in Embodiment 4. The drawn fibers are heat set, packaged and cut to obtain the finished product. The tensile strength of the polyester amide fiber in this embodiment reaches 1000 MPa and the tensile modulus reaches 8 GPa.

Embodiment 6

This embodiment is applied to the preparation of high strength polyvinyl alcohol fibers.

The preparation process is shown in FIG. 2 and includes the following steps:

After swelling, polyvinyl alcohol is added into a single screw extruder for melt extrusion. After the fibers are extruded, freezing, alcoholysis and neutralization are carried out. The fibers are subjected to two-stage high temperature segmented drawing. In the first stage, the total length of the heating oven is 6 m. The length of the front heating part is 4 m and the temperature is 90° C. The length of the latter heating part is 2 m and the temperature is 100° C. The drawing ratio is 3. In the second stage, the total length of the heating oven is 6 m. The front heating part length is 4 m and temperature is 140° C. The length of the latter heating part length is 2 m and temperature is 150° C. The drawing ratio is 6. The control method of the drawing speed rate is the same as in Embodiment 4. The drawn fiber is heat set, packaged and cut at 220° C. to obtain the finished product. The tensile strength of the polyvinyl alcohol fiber in this embodiment reaches 950 MPa and the tensile modulus reaches 35 GPa.

Embodiment 7

Figure 3:
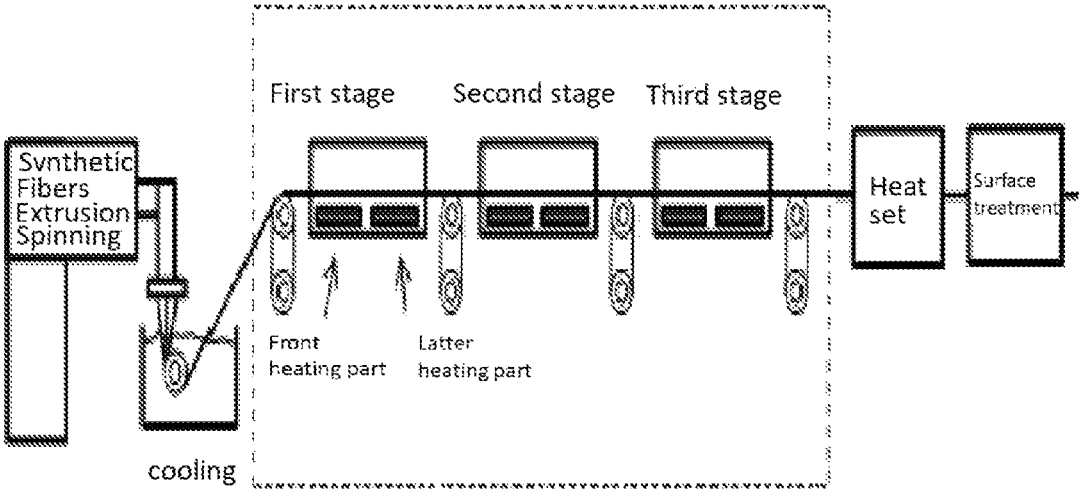
FIG. 3 is a schematic diagram of the device of Embodiment 7 to 9 of the present invention.

This embodiment is applied to the preparation of high strength polypropylene fibers. The preparation process is shown in FIG. 3 and includes the following steps:

Polypropylene resin, maleic anhydride grafted polypropylene, color master batch, high temperature resistant master batch, anti-corrosion master batch and defoaming master batch are fully and evenly mixed and then added into a single screw extruder for melt extrusion. After the fibers are extruded, they are immediately cooled in cooling water to obtain undrawn filaments in an amorphous state. The fibers are subjected to three-stage high temperature segmented drawing. In the first stage, the total length of the heating oven is 6 m. The length of the front heating part is 2 m and the temperature is 40° C. The length of the latter heating part is 4 m and the temperature is 50° C. Both ends of the first oven are respectively provided with a roller. The rotating speed of the first roller is 3 m/min, the rotating speed of the second roller is 6 m/min, and the drawing ratio is 2. In the second stage, the total length of the heating oven is 6 m. The length of the front heating part is 2 m and the temperature is 120° C. The length of the latter heating part is 4 m and the temperature is 140° C. The roller at the rear end of the first oven and the roller at the front end of the second oven is the same one. The rotating speed of the roller at the rear end of the second oven is 24 m/min, and the drawing ratio is 4. In the third stage, the total length of the heating oven is 6 m. The length of the front heating part is 2 m and the temperature is 150° C. The length of the rear heating part is 4 m and the temperature is 160° C. The roller at the rear end of the second oven and the roller at the front end of the third oven is the same one. The rotating speed of the roller at the rear end of the third oven is 144 m/min, and the drawing ratio is 6. The drafted fiber is heat set at 120° C. for 40 s. After that, the fibers are indented, modified, packaged and cut to obtain the finished product. The tensile strength of the polypropylene fiber in this embodiment reaches 700 MPa and the tensile modulus reaches 15 GPa. It is also possible to further add the fourth or even fifth stage high temperature segmented drawing according to needs, under the same conditions as the third stage.

Embodiment 8

This embodiment is applied to the preparation of high strength polyester amide fibers. The preparation process is shown in FIG. 3 and includes the following steps:

Nylon 6 and polybutylene adipate are copolymerized and then added into a single screw extruder for melt extrusion. After the fibers are extruded, they are immediately cooled in cooling water to obtain undrawn filaments in an amorphous state. The fibers are subjected to three-stage high temperature segmented drawing. In the first stage, the total length of the heating oven is 6 m. The length of the front heating part is 3 m and the temperature is 20° C. The length of the latter heating part is 3 m and the temperature is 30° C. The drawing ratio is 1. In the second stage, the total length of the heating oven is 6 m. The length of the front heating part is 3 m and the temperature is 40° C. The length of the latter heating part is 3 m and the temperature is 60° C. The drawing ratio is 3. In the third stage, the total length of the heating oven is 6 m. The length of the front heating part is 3 m and the temperature is 70° C. The length of the rear heating part is 3 m and the temperature is 80° C. The drawing ratio is 5. The rate control method is the same as in Embodiment 7. The drafted fibers are heat set, packaged and cut to obtain the finished product. The tensile strength of the polyester amide fiber in this embodiment reaches 1500 MPa and the Tensile modulus reaches 10 GPa.

Embodiment 9

This embodiment is applied to the preparation of high to strength polyvinyl alcohol fibers. the preparation process is shown in FIG. 3 and includes the following steps:

After swelling, polyvinyl alcohol is added into a single screw extruder for melt extrusion. After the fibers are extruded, freezing, alcoholysis and neutralization are carried out. The fiber are subjected to three stages of high temperature segmented drawing. In the first stage, the total length of the heating oven is 6 m. The length of the front heating part is 4 m and the temperature is 90° C. The length of the rear heating part is 2 m and the temperature is 100° C. And the drawing ratio is 2. In the second drawing stage, the total length of the heating oven is 6 m. The length of the front heating part is 4 m and the temperature is 140° C. The length of the rear heating part is 2 m and the temperature is 150° C. The drawing ratio is 3. In the third drawing stage, the total length of the heating oven is 6 m. The length of the front heating part is 4 m and the temperature is 190° C. The length of the rear heating part is 2 m and the temperature is 200° C. The drawing ratio is 5. The rate control method is the same as in Embodiment 7. The drawn fibers are heat set, packaged and cut at 220° C. to obtain the finished product. The tensile strength of the polyvinyl alcohol fiber in this embodiment reaches 1200 MPa and the tensile modulus reaches 40 GPa.

The above described are only some preferred embodiments of the present invention, but the scope of protection of the present invention is not limited to the above embodiments. Any changes or substitutions, such as specific temperature adjustment of front and rear, which can be easily thought of by those skilled in this art, do not depart from the scope of protection of this present invention. Therefore, the scope of protection of the present invention should be based on that of the claims.

We claim:

1. A method for preparing high strength synthetic fibers by high temperature segmented drawing processes, comprising the following steps: melt spinning or melt extrusion of synthetic resins, cooling, high temperature segmented drawing and heat setting; wherein in the high temperature segmented drawing, the temperature of a front part and a latter part of an oven is independently controlled, where the temperature of the latter part is higher than that of the front part, the heating temperature of the front part in the oven is 30 to 200° C., and that of the latter part is 50 to 300° C.

2. The method as claimed in claim 1, wherein the drawing ratio is 1 to 50 times.

3. A method for preparing high strength synthetic fibers by two-stage high temperature segmented drawing processes, comprising the following steps: melt spinning or melt extrusion of synthetic resins, cooling, high temperature segmented drawing and heat setting;

wherein the high temperature segmented drawing comprises a first and a second drawing stages in first and second ovens respectively, the temperature of a front part and a latter part of the first oven being independently controlled, where the temperature of the latter part is higher than that of the front part and the heating temperature of the front part of the second drawing stage is not lower than that of the latter part of the first drawing stage, in the first drawing stage, the temperature of the front part in the first oven is 30 to 200° C. and the heating temperature of the latter part is 50 to 300° C.; in the second drawing stage, the heating temperature of the front part in the second oven is 100 to 300° C., and the heating temperature of the latter part is 120 to 300° C.

4. The method as claimed in claim 3, wherein the drawing ratio is 1 to 50 in the first drawing stage, and the drawing ratio is 1 to 80 in the second drawing stage.

5. A method for preparing high strength synthetic fibers by multi-stage high temperature segmented drawing processes, comprising the following steps: melt spinning or melt extrusion of synthetic resins, cooling, high temperature segmented drawing and heat setting;

wherein the high temperature segmented drawing comprises multiple stages, the high temperature segmented drawing process comprises sequentially entering multiple ovens, and the heating temperature and drawing ratio of the front part of a latter oven in the multiple ovens is not lower than that of a front oven in the multiple ovens, wherein in the high temperature segmented drawing, the temperature of a front part and a latter part of one of the ovens is independently controlled and the temperature of the latter part is higher than that of the front part, at least three stages of high temperature drawing are included, and the first three stages of high temperature drawing are as follows: the heating temperature of the front part in the first drawing stage is 30 to 200° C., and the heating temperature in the latter part is 50 to 200; the heating temperature of front part in the second drawing stage is 100 to 250° C., and the heating temperature of the latter stage is 120 to 250° C.; the heating temperature of front part in the third drawing stage is 100 to 300° C., and the heating temperature of the latter part is 120 to 300° C.

6. The method as claimed in claim 5, wherein the multi-stage high temperature segmented drawing process comprises three stages.

7. The method as claimed in claim 5, wherein the drawing ratio of the first stage is 1 to 50, the drawing ratio of the second stage is 1 to 80, and the drawing ratio of the third stage is 1 to 100.

8. The method as claimed in claim 5, wherein there are more than three stages in multi-stage high temperature segmented drawing, and the temperature and the drawing ratio after the third stage are the same as those of the third stage.

9. The method as claimed in claim 1, wherein the length ratio of the front heating part to the latter heating part in the oven is 1:5 to 5:1.

10. The method as claimed in claim 9, wherein the length ratio of the front heating part to the latter heating part in the oven is 1:3 to 3:1.

11. The method as claimed in claim 1, wherein the synthetic resins are one of or a mixture of more than one of the following chemicals: polypropylene, polyethylene, polyacrylonitrile fiber, polyester, polyamide, polyvinyl alcohol, polyvinyl formal, polyethylene terephthalate, polybenzimidazole, polytetrafluoroethylene, Poly(p-phenylene terephthalamide) and polyimide.

12. The method as claimed in claim 1, wherein the synthetic resins include modifiers, modified resins or modified fillers.

13. The method as claimed in claim 12, wherein the modifiers, modified resins or modified fillers are one of or a mixture of following chemicals: silane coupling agent Si-69, silane coupling agent KH570, silane coupling agent KH550, silane coupling agent KH151, silica gel anti-blocking agent, titanate coupling agent, aluminate coupling agent, tetraethyl orthosilicate (TEOS), color masterbatch, plasticizing masterbatch, high-temperature-resistant masterbatch, anti-corrosion masterbatch, defoaming masterbatch, inorganic ultrafine particles, maleic anhydride grafted polypropylene, maleic anhydride grafted polyethylene, polyethylene glycol, polybutylene adipate, and polycaprolactone.

14. The method as claimed in claim 1, wherein fiber surface treatment is performed after heat setting.

* * * * *